United States Patent [19]

Gillette

[11] Patent Number: 4,912,609

[45] Date of Patent: Mar. 27, 1990

[54] PERSONALIZED NIGHT-LIGHT

[76] Inventor: Kenneth R. Gillette, P.O. Box 742, Union Station, Endicott, N.Y. 13760

[21] Appl. No.: 264,655

[22] Filed: Oct. 31, 1988

[51] Int. Cl.[4] ..... F21S 1/02

[52] U.S. Cl. ..... 362/147; 362/226; 362/812

[58] Field of Search ..... 362/226, 812, 457, 147

[56] References Cited

U.S. PATENT DOCUMENTS

| | | | |
|---|---|---|---|
| 3,203,126 | 8/1965 | Eliot | 362/226 |
| 3,406,475 | 10/1968 | O'Donnell | 362/812 |
| 4,611,206 | 9/1986 | Schwartz | 362/226 |
| 4,628,419 | 12/1986 | Schmid | 362/226 |
| 4,774,645 | 9/1988 | Iwamoto | 362/457 |

*Primary Examiner*—Ira S. Lazarus
*Assistant Examiner*—Sue Hagarman
*Attorney, Agent, or Firm*—Salzman & Levy

[57] ABSTRACT

The invention relates to a personalized night-light having its user's name illuminated. The night-light comprises a canopy having the name engraved or cut into its face portion. The canopy is hollow and fits over a standard electrical night-light base, whose prongs plug into the socket of a wall outlet. The canopy has illuminated borders to highlight the illuminated name.

17 Claims, 1 Drawing Sheet

PERSONALIZED NIGHT-LIGHT

FIELD OF THE INVENTION

The invention relates to a night-light which plugs into a wall outlet, and more particularly to a night-light or night-light kit for personalizing the night-light by illuminating the name of its user.

BACKGROUND OF THE INVENTION

Commercially available night-lights generally consist of a base portion having prongs which directly plug into a wall outlet. The base portion has a neck extension which receives a small wattage bulb. A plastic shade or canopy fits over the bulb.

One such night-light is shown in the U.S. Pat. No. 4,343,032; issued; Aug. 3, 1982.

The night-light arts are filled with many innovations.

A particularly interesting improvement is illustrated in U.S. Pat. No. 4,714,984; issued: Dec. 22, 1987. In this patent, a night-light has a window in the shade portion which can be filled with a picture, such as a flower. On the back of the picture is a pad containing a liquid which when volatilized by the heat of the bulb, will exude a characteristic flower odor.

The present invention seeks to provide a means by which night-lights can be personalized, i.e. where children can have their own night-lights having their names thereon in glowing letters.

A personalized night-light in a child's room has the advantage of providing a warm and homey feeling.

The invention teaches a simple method of customizing a standard night-light electrical base with a canopy or shade having a boy or girl's name thereon.

The canopy can be made as part of a kit, wherein the old shade is removed, and the new canopy inserted in its place. The canopy can be attached to the base by means of a snap-in bayonet fixture, which is moulded to the base or constructed from plastic inserts.

The canopy may also be adhered or bonded to the base by an adhesive washer which fits over the neck portion of the bulb extension.

In another embodiment of the invention, the base and canopy can be sold as a unit on a rack with other such units, wherein a whole rack of personalized name-bearing night-lights are displayed.

SUMMARY OF THE INVENTION

The invention features a personalized night-light apparatus having an illuminated name disposed upon a night-light canopy which surrounds an internal light source. The night-light comprises a generally opaque, hollow canopy having a face portion. The canopy is engageable with a base fixture generally comprising an electrical switch that plugs directly into a wall socket.

An aperture in the canopy receives the neck portion of the light emitting element of the base fixture, which neck portion is inserted therein.

The name of the child or user is disposed on the face portion of the canopy. The name is transmissive of the light generated by the emitting element.

The neck portion of the base fixture has locking means for interlocking the neck portion with the canopy after insertion of the light emitting element into the aperture.

BRIEF DESCRIPTION OF THE DRAWINGS

A complete understanding of the present invention may be obtained by reference to the accompanying drawings, when taken in conjunction with the detailed description thereof and in which.

DESCRIPTION OF THE PREFERRED EMBODIMENT

Generally speaking, the invention pertains to a personalized night-light, which can be constructed as a kit. The night-light features a shade or canopy having illuminated lettering bearing the name of the user.

For purposes of brevity, the same elements and components will bear the same designation throughout the figures.

Figure 1:
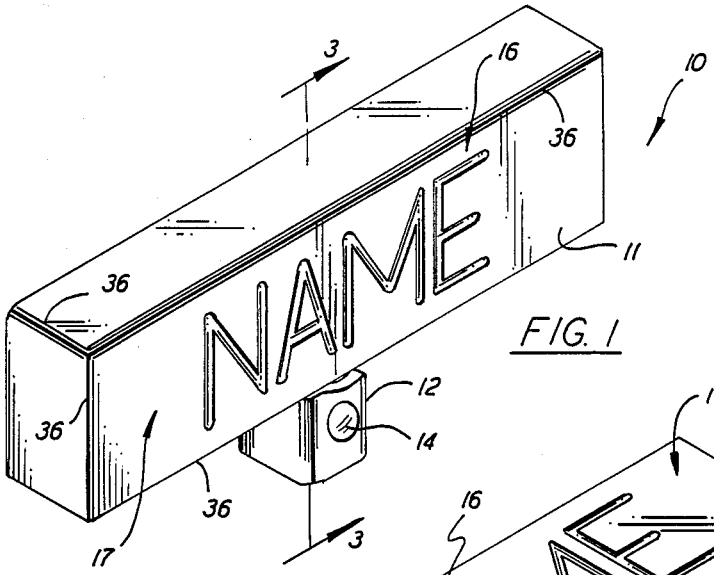
FIG. 1 is a perspective view of the night-light of this invention.
Figure 2:
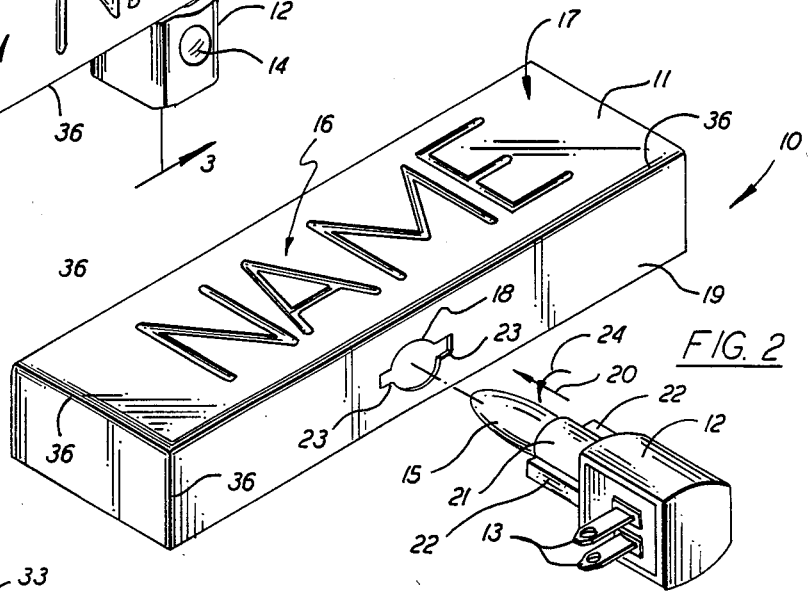
FIG. 2 is an exploded, perspective view of the night-light of FIG. 1 illustrating how the canopy interlocks with the electrical base.
Figure 3:
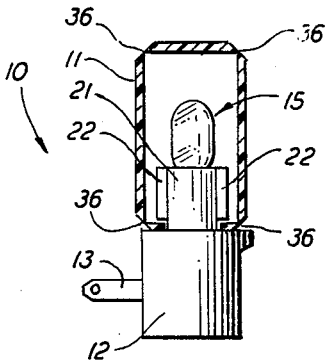
FIG. 3 is a sectional view of the night-light of the invention, taken along lines 3—3 of FIG. 1.

Now referring to FIGS. 1 through 3, the personalized night-light of this invention is shown by arrow 10. The night-light 10 consists of a rectangular, hollow canopy 11 which attaches to a standard electrical base 12. the base 12 has two prongs 13 (FIG. 2) which plug into a socket of a wall outlet (not shown). The base 12 also may contain a switch or a light-sensitive photocell 14 (FIG. 1) for passing the current to the light bulb 15 for illuminating the canopy 11 after dark. A suitable electrical base 12 with photocell 14 is available as Model No. LBN-2A by Long Best Enterprise Co., Ltd., Taiwan. A suitable circuit for this device 10 is shown and described in U.S. Pat. No. 4,343,032, herein incorporated by reference. In the preferred embodiment light bulb 15 is a 6-watt bulb.

The canopy 11 is generally opaque, or semi-opaque and is formed by assembling six prefabricated planar sides by means of adhesive, vacuum forming, heat treatment or other suitable methods known in the art. Alternatively, canopy 11 can be formed in one piece by means of bending, folding, injection molding or other suitable plastic forming technology. The canopy 11 has a name 16 engraved or cut into a face portion 17 of the canopy 11. The name 16 is illuminated by bulb 15 and comprises the identity of the user, whereby the night-light becomes a personalized unit. It should be understood that any alphanumeric character or set of alphanumeric characters may be used in an identifying manner within the scope of the present invention.

The invention contemplates commercializing the night-light 10 either as a finished product or as a kit wherein the canopy 11 can be attached to the electrical base 12 by the user.

The invention has kept the assembly simple, in order to provide ease of fabrication, even for children.

The canopy 11 can be attached to the base 12 by a bayonet interlock. The canopy 11 has a hole 18 in the bottom surface 19. The bulb 15 (FIG. 2) is inserted (arrow 20) into hole 18, as shown. The neck portion 21 of base 12 has bayonet ears 22 disposed on either side thereof. The bayonet ears 22 respectively fit into slots 23 of hole 18, when bulb 15 is inserted into canopy 11. The base 12 is then twisted (arrow 24) in a counter clockwise direction to lock the canopy 11 to base 12, as shown in FIGS. 1 and 3.

Figure 4:
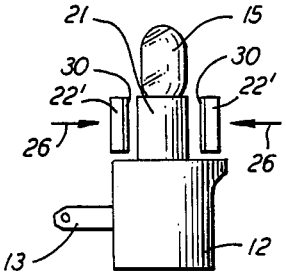
FIG. 4 is a side view of the electrical base depicting the modification of the neck portion.

The bayonet ears 22 can be integrally molded with neck portion 21 and base 12, or they may be attached to a standard neck portion 21, as shown in FIG. 4. Bayonet ears 22 can be constructed as strips 22', which have a layer 30 of adhesive for attachment (arrows 26) to neck portion 21.

Figure 5A:
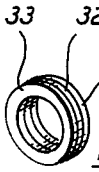
FIG. 5*a* is a perspective view of the adhesively coated washer for attaching the canopy to the base, as illustrated in FIG. 5.
Figure 5:
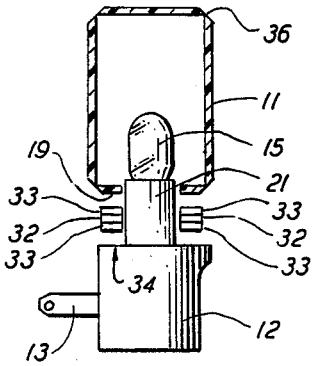
FIG. 5 is an alternate embodiment of the night-light construction shown in sectional view.

In another embodiment, as shown in FIGS. 5 and 5*a*, the canopy 11 can be attached to the base 12, by means of a washer 32 having an adhesive layer on each side. The washer 32 slips over the neck portion 21 and sticks to the top surface 34 of base 12. The canopy 11 is then inserted over the bulb 15 and neck portion 21, wherein its bottom surface 19 sticks to washer 32.

In order to further highlight the illuminated name 16, the canopy 11 can be constructed with grooves or beveled edges 36 cut into its borders. Each and every edge 36 of the canopy 11 will become illuminated to form a complete, illuminated rectangular box—top, bottom, front, back and sides—forming a frame about the illuminated name 16. The canopy 11 can be fabricated of safety approved plastic, and can be coated with a color opaque or semi-opaque enamel.

Other materials can also be used as is well known in this art.

Having thus described the invention, what is desired to be protected by Letters patent is presented by the subsequently appended claims.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

What is claimed is:

1. A personalized night-light apparatus having an illuminated name of a user disposed upon a night light canopy which surrounds an internal light source and which can be assembled at said user's home, said night-light comprising:

a generally opaque, hollow, rectilinear canopy having a face portion, said opaque canopy adaptable for personal engagement by a user in said user's home with a base fixture, said opaque canopy having means defining an aperture into which a neck portion of a replaceable incandescent light emitting element of said base fixture is insertable and removable by said user, said replaceable incandescent light emitting element being substantially centrally disposed with respect to said canopy, said opaque canopy having a name of said user of said night-light disposed upon said face portion, said name being transmissive of light generated by said replaceable incandescent light emitting element, and said canopy being interchangeable with others of a plurality of canopies, and wherein said neck portion of said base fixture has locking means for interlocking said neck portion within said opaque canopy after insertion of said light emitting element into said aperture.

2. The personalized night-light apparatus of claim 1, wherein said locking means comprises a bayonet extension which interengages with a mating portion of said aperture.

3. The personalized night-light apparatus of claim 1, wherein said opaque canopy comprises a generally rectangular prism shroud.

4. The personalized night-light apparatus of claim 3, wherein borders of said rectangular shroud are light transmissive.

5. A kit for assembling a personalized night-light fixture in a user's home wherein a canopy containing an illuminated user name is attached to, and fits over, a replaceable incandescent light emitting element of a night-light fixture in said user's home, said kit comprising in combination:

a commercially available night-light fixture for plugging into a wall socket, said fixture having a neck portion for inserting or removing said replaceable incandescent light emitting element therein;

a generally opaque, hollow rectilinear canopy for attachment to said night-light fixture, said canopy being fitted by said user over said replaceable incandescent light emitting element of said night-light fixture in a user's home, said canopy having a surface defining a face portion, said face portion containing a name of said user, and wherein said name is light transmissive such that said replaceable incandescent light emitting element illuminates said name; and user attaching mean for attaching said canopy to said night-light fixture in an easily attachable fashion in said user's home, said canopy being interchangeable with others of a plurality of canopies.

6. The kit of claim 5, wherein said attaching means comprises means defining bayonet snap-in mating surfaces disposed between said canopy and said night-light fixture.

7. The kit of claim 6, wherein said attaching means further comprises adhesive strips for attachment to said neck portion by said user in order to provide bayonet prongs.

8. The kit of claim 5, wherein said canopy comprises a generally rectangular prism shroud.

9. The kit of claim 8, wherein borders of said rectangular prism shroud are light transmissive.

10. The kit of claim 5, wherein said attachment means further comprises a double-sided adhesive insert disposed between said canopy and said night-light fixture.

11. The kit of claim 10, wherein said adhesive insert comprises an annular ring which fits over said neck portion of said night-light fixture.

12. A personalized night-light for assembly by a user, comprising in combination:

a commercially available electrical base for plugging into an electrical wall outlet, said electrical base having a neck portion for receiving a replaceable incandescent light emitting element, such as a bulb;

a generally opaque, hollow canopy for attachment to said electrical base, said canopy fitting over said neck portion and surrounding said light emitting element, said canopy having a name of a user disposed on a surface thereof defining a face portion, said name being light transmissive; and non-permanent attachment means for personally attaching said canopy by said user to said electrical base, such that the canopy can be later separated from the base, and one of a plurality of new canopies, with a different user name, inserted and attached in its place.

13. The personalized night-light of claim 12, wherein said attachment means comprises a washer for insertion over said neck portion of said electrical base, said washer having adhesive surfaces for bonding said electrical base to said canopy.

14. The personalized night-light of claim 12, wherein said attachment means comprises two adhesively-backed strips for attachment to the neck portion of said electrical base for forming bayonet ears on said neck portion, said canopy further comprising means defining an aperture, said aperture having slots for insertion of the bayonet ears.

15. The personalized night-light of claim 12, wherein said attachment means comprises bayonet ears which are molded as an integral part of said neck portion of said electrical base, said bayonet ears being insertable into a slot portion of an aperture formed in said canopy.

16. The personalized night-light of claim 12, wherein said canopy has illuminated borders to highlight said illuminated name.

17. The personalized night-light of claim 12, wherein said canopy comprises a generally rectangular prism shroud.

* * * * *